United States Patent [19]

Welborn

[11] 4,152,985

[45] May 8, 1979

[54] HOLD-DOWN CLAMP ASSEMBLY FOR UPPER SWINGABLE INKER OF PERFECTING PRESS

[75] Inventor: Ronald D. Welborn, Emporia, Kans.

[73] Assignee: Didde-Glaser, Incorporated, Emporia, Kans.

[21] Appl. No.: 858,099

[22] Filed: Dec. 7, 1977

[51] Int. Cl.[2] ..... B41L 27/38; B41F 31/36

[52] U.S. Cl. ..... 101/352; 101/247

[58] Field of Search ..... 101/352, 351, 350, 349, 101/247, 209, 206–208, 181, 182, 184, 185, 148

[56] References Cited

U.S. PATENT DOCUMENTS

| | | | |
|---|---|---|---|
| 1,952,028 | 3/1934 | Hehle et al. | 101/209 X |
| 2,583,639 | 1/1952 | Faeber et al. | 101/352 |
| 2,965,023 | 12/1960 | Boule et al. | 101/352 |
| 3,286,622 | 11/1966 | Mestre | 101/352 X |
| 3,892,178 | 7/1975 | Staamann | 101/182 |
| 4,036,131 | 7/1977 | Elmore | 101/247 |

*Primary Examiner*—J. Reed Fisher

*Attorney, Agent, or Firm*—Schmidt, Johnson, Hovey & Williams

[57] ABSTRACT

In an offset printing press the inker is normally clamped down against the printing section so as to transfer ink from the form roll of the inker to the plate cylinder of the printing section, but upon actuation of an air cylinder to extend the rod thereof, a clamping jaw on the outer end of the rod releases its grip on a latch lever and pushes against the frame of the printing section, thereby incrementally raising the inker and effecting slight separation of the form roll and plate cylinder. Such slight separation is not, however, sufficient to disengage drive mechanism associated with the form roll and plate cylinder so that the form roll may continue to rotate notwithstanding the slight separation. Substantial separation of the form roll and plate cylinder sufficient to disengage the drive mechanism may be effected by leaving the rod of the air cylinder extended so that the jaw on the rod is out of clamping engagement with the latching lever, whereupon raising of the inker by means other than the air cylinder causes the jaw to flip the swingable latch lever to a released position as the cylinder is raised with the inker.

7 Claims, 6 Drawing Figures

HOLD-DOWN CLAMP ASSEMBLY FOR UPPER SWINGABLE INKER OF PERFECTING PRESS

This invention relates to the field of offset printing. It is particularly directed to the relationship between the inker of an offset press and the printing section thereof, especially the form roll of the inker and the plate cylinder of the printing section.

During start-up, it is preferable that the form roll and plate cylinder be maintained out of engagement with one another until the form roll has first received a proper amount of evenly distributed ink along its transfer surface. Only after the form roll has been properly prepared in this manner is it then desirable to bring the form roll and plate cylinder into engagement, such as to transfer ink to the printing section of the press. Typically, however, the form roll is driven by mechanism associated with the plate cylinder, and since it is necessary to spin the form roll during the time that the same is receiving its ink load, it is necessary to maintain driving interengagement of the mechanism between the plate cylinder and the form roll, notwithstanding the slight separation between the transfer surfaces of the roll and cylinder.

While it is not new per se to effect this kind of slight separation of the form roll and plate cylinder without disabling the drive mechanism between the two parts, prior arrangements for achieving this end have been largely unsatisfactory for a number of reasons, not the least of which involves the excessive degree of operator attention required to release parts, cause separation, and re-establish proper conditions for printing.

In light of the foregoing, one important object of the present invention is to provide a way of achieving slight separation of the form roll and plate cylinder without disengagement of the drive mechanism therebetween that eliminates the need for operator attention and adjustment to assure that the inker and printing section are properly relatched in their ink-transferring relationship upon return of the form roll and plate cylinder into engagement with one another.

Another important object of this invention is to facilitate raising of the inker to an access position wherein there is disengagement of the drive between the form roll and the plate cylinder by virtue of an automatic unlatching of the inker with the printing section.

Additionally, an important object of this invention is to achieve the two foregoing objects without interferring with the operation of mechanism that slightly separates the form roll and plate cylinder without disengaging the drive between the two.

A still further important object of the invention is to achieve the foregoing objects and yet minimize the number of components involved. In this respect, one feature of the present invention resides in utilizing one particular component not only as a part of the assembly that latches the inker and printing section in operative engagement with one another, but also as a part of the means for powering the slight separation of the inker and printing section without disengaging the drive between the form roll and plate cylinder. In this same vein, it is an important feature of the invention to utilize such particular component in the additional roles of serving as the means for releasing the latch during large scale separation of the inker and printing section, and for returning such latch to its original position during corresponding return of the inker and printing section into operative engagement with one another.

Figure 1:
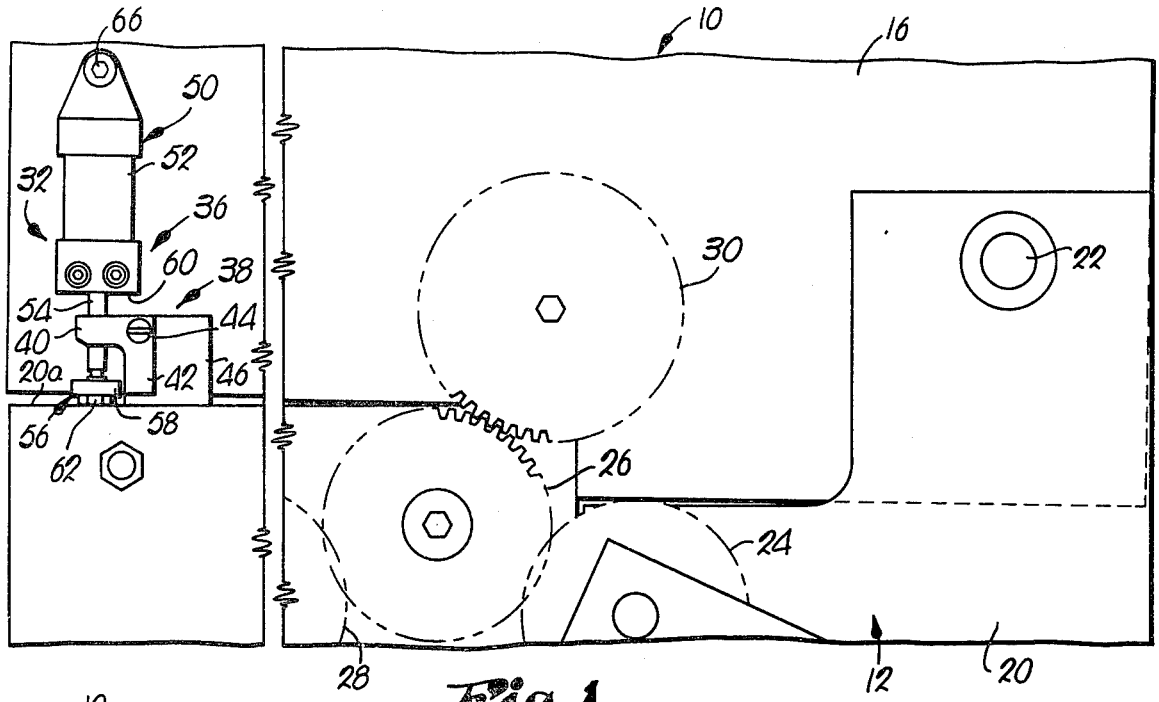
FIG. 1 is a fragmentary, side elevational view of an offset printing press utilizing a hold-down clamping assembly in accordance with the principles of the present invention, the press being illustrated with the upper inker thereof raised slightly from the lower printing section without disengaging the drive for the form roll and plate cylinder.

The inker section 10 and the printing section 12 of the press each include a sizable number of rolls and cylinders that have not been illustrated in order to most clearly depict the present invention. Suffice it to point out that the inker 10 includes a form roll 14 rotatably supported by a pair of spaced frame members 16 at opposite ends of the roll 14, and that the printing section 12 includes a plate roll or cylinder 18 rotatably supported by a second pair of frame members 20 at opposite ends of the cylinder 18. Ink supplied to the form roll 14 by means not shown is then transferred to the plate cylinder 18 when the two are rotated and in peripheral engagement with one another, whereupon the plate cylinder 18 transfers its ink to a blanket cylinder (not shown), thence on to a web or the like of paper stock moving through a nip between the blanket cylinder and a coacting cylinder (not shown).

The upper frame members 16 are swingably mounted on the lower frame members 20 by suitable pivots, such as the pivot 22 in FIG. 1. Drive mechanism comprising a gear train that includes gears 24 and 26 supplies driving power to the plate cylinder 18, the gear 26 being fixed to cylinder 18 for rotation therewith. Gear 26 is also disposed in interengagement with a third gear 28 that supplies driving power to other unillustrated cylinders of the printing section 12. A fourth gear 30 secured to the form roll 14 for rotation therewith is disposed above the gear 26 in such a position that its peripheral teeth may be operably interengaged with those of the gear 26 depending upon the position of the inker 10 about the pivots 22. Thus, the form roll 14 receives its driving power from the gear 26 of plate cylinder 18.

The press is provided with a pair of identical hold-down latch assemblies 32 and 34 on the two opposite sides of the machine. For convenience, and because of their identity, only the assembly 32 will be described in detail. The assembly 32 includes interengageable structure on the members 16 and 20 that may be broadly denoted by the numerals 36 and 38, respectively. The structure 38 on member 20 includes a pair of levers 40 and 42 that are integrated into a unitary device presenting an inverted, L-shaped configuration as a result of the convergence of the two levers 40, 42 toward one another at substantially right angles. Each of the two levers 40 and 42 is actually bifurcated so as to present identical, laterally spaced parts 40*a*, 40*b* and 42*a*, 42*b*, as illustrated best in FIG. 3. Integral levers 40 and 42 are swingable on a common horizontally extending pivot bolt 44 which in turn is supported by a block 46 rigid to and extending upwardly from the proximal upper surface 20*a* of frame member 20. As will hereinafter become apparent, during use of the assembly 32, the lever 40 and the upper surface 20*a* effectively become opposed shoulders.

Figure 4:
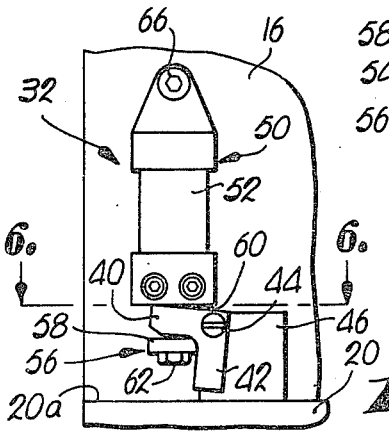
FIG. 4 is a fragmentary, detailed view of the latching assembly corresponding to the condition of things in FIG. 3, wherein the inker and printing section are retained against separation.
Figure 6:
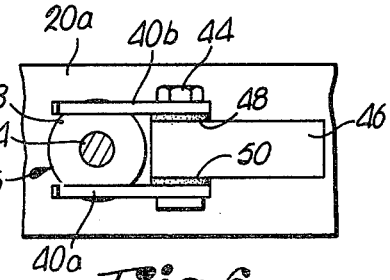
FIG. 6 is a fragmentary, cross-sectional view through the assembly taken along line 6—6 of FIG. 4.
Figure 5:
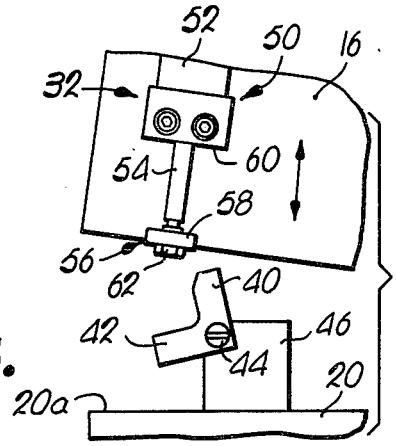
FIG. 5 is a view similar to FIG. 4, but with the latch released and the inker and printing section separated to disengage not only the form roll and plate cylinder, but also the drive mechanism therebetween.

The levers 40 and 42 are swingable about the axis of the pivot bolt 44 between what may be termed a latching position as illustrated in FIGS. 1 and 4, and a releasing position as illustrated in FIG. 5. Friction washers 48 and 50 are clamped against opposite sides of the block 46 by the pivot bolt 44 and the opposite halves a and b of the levers 40, 42 so as to yieldably resist swinging of the levers 40, 42 between such two extreme positions. The friction force is sufficient to yieldably retain the levers 40, 42 in such positions.

The structure 36 on the frame member 16 includes a fluid-pressure unit 50 in the nature of an air cylinder. The air cylinder 50 has a cylinder 52 that telescopically receives a depending rod element 54, the air cylinder 50 being double-acting so that the rod 54 may be positively extended and retracted from the cylinder 52.

A jaw 56 is presented at the outermost end of the rod 54 by a disc 58 of sufficient diameter to bridge the two parts 40*a* and 40*b* of the lever 40, as well as the two parts 42*a* and 42*b* of the lever 42. A second jaw 60 is defined by the lowermost end of the cylinder 52 and is disposed in opposed, cooperating relationship with the jaw 56. Thus, the two jaws 56 and 60 effectively define a clamp having a stationary jaw 60 and a movable jaw 56. A hex head 62 on the bottom side of the jaw 56 between the two parts a and b of levers 40, 42 is disposed for abutting engagement with the top surface 20*a* of the frame member 20.

Figure 3:
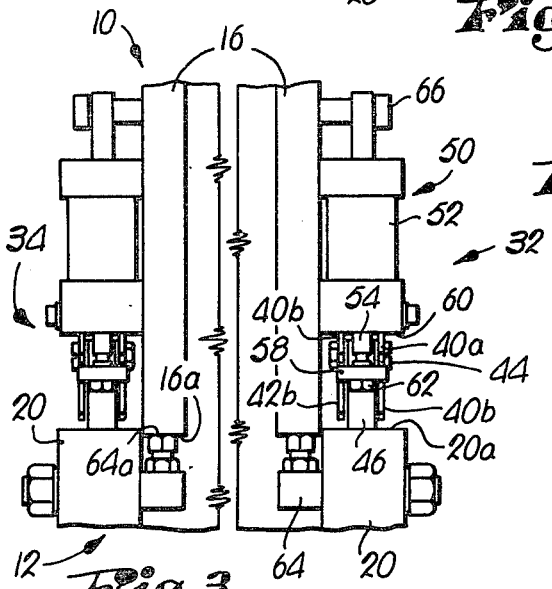
FIG. 3 is a fragmentary, end elevational view of the press with the inker latched firmly down against the printing section.

As illustrated in FIG. 3, the frame members 16 are disposed slightly inboard of the frame members 20, and the latter are provided with a pair of laterally inwardly disposed stop assemblies 64. Each of the assemblies 64 is vertically aligned with a corresponding one of the side members 16 so that the upper face 64*a* of each assembly 64 is disposed for limiting engagement with the lower edge 16*a* of the corresponding member 16. Each assembly 64 may be rendered adjustable by virtue of its nut and bolt construction, and it is to be noted that the vertical location of the upper surface 64*a* determines the degree of interengagement between the form roll 14 and the plate cylinder 18 when the inker 10 is fully down against the printing section 12. Thus, adjustment of the assembly 64 affects the contacting relationship of the form roll 14 and the plate cylinder 18.

During a printing run the inker 10 will be fully down against the printing section 20 with the lower surfaces 16*a* of frame member 16 resting upon the upper surfaces 64*a* of the limit assemblies 64 associated with frame members 20. Form roll 14 will be in ink-transferring engagement with plate cylinder 18, gear 26 will be driving gear 30 so that form roll 14 and plate cylinder 18 are rotating in opposite directions, and the air cylinder 50 will have its rod 54 fully retracted so that the jaws 56 and 60 are clamped around the lever 40 (hereinafter referred to as the "latch" lever 40) in the manner illustrated in FIG. 4. With latch lever 40 thusly clamped in its latching position, the inker 10 cannot be raised from the printing section 12.

Figure 2:
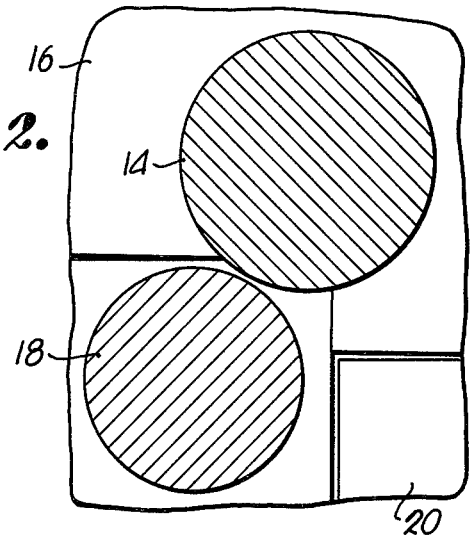
FIG. 2 is a fragmentary, cross-sectional view through the form roll and plate cylinder of the press illustrating the roll and cylinder slightly separated corresponding to the condition of things in FIG. 1.

If for any reason it is desired to slightly separate the form roll 14 and the plate cylinder 18 without disengaging the drive gears 26 and 30, this is readily accomplished by actuating the air cylinder 50 to extend the rod 54 thereof. This action opens the jaws 56 and 60 as the hex head 62 of the lower jaw 56 is moved down into abutting engagement with the upper surface 20*a* of the frame member 20. Continued extension of the rod 54 will cause a reaction force to be transmitted to the upper frame member 16 through the point of attachment 66 of the air cylinder 50 to the frame member 16 so as to cause the inker 10 to rise. The length of the rod 54 is such that it can only be extended to the degree illustrated in FIG. 1 which, while being sufficient to cause slight separation of the roll 14 and the plate cylinder 18 as illustrated in FIG. 2, is insufficient to disengage the gears 26 and 30. Hence, the form roll 14 continues to rotate along with the plate cylinder 18. A retraction of the rod 54 simply allows the inker 10 to lower back into its original position as the movable jaw 56 cooperates with the stationary jaw 60 to re-clamp the latch lever 40 therebetween, once again bringing the form roll 14 into ink-transferring engagement with the plate cylinder 18.

If instead of only slight separation of the inker 10 and the printing section 12 a more large scale separation is desired, such as for facilitating access to the interior of the press, at which time not only will the form roll 14 and the cylinder 18 be out of engagement, but also the gears 26 and 30, this too can be readily accomplished by first opening the jaws 56 and 60 by again actuating the air cylinder 50 to extend the rod 54 its full amount. Thereupon, raising of the inker 10 by any suitable means other than the air cylinder 50 and not illustrated in the drawing causes the jaw 56 to engage and flip the latch lever 40 into a released position as illustrated in FIG. 5 during upward swinging of the inker 10. The latch lever 40 remains in this released position due to the frictional effect of the washers 48, 50 until such time as the jaw 56 engages the lever 42 (hereinafter referred to as the "reset" lever 42) during return of the inker 10 down against the printing section 12. Such engagement of the jaw 56 with the reset lever 42 returns the latch lever 40 into its latching position and locates the same once again between the jaws 56 and 60 so that it is then only necessary to retract the rod 54 within the cylinder 52, thereby clamping the latch lever 40 between jaws 56 and 60 to once again effectively hold the inker 10 down against the printing section 12.

While it is thus apparent from the foregoing that the present invention effectively combines a separator for slight disengagement of roll 14 and cylinder 18, a hold-down latch to retain the inker 10 against the printing section 12, and a way of automatically releasing such latch to permit large scale separation of the inker 10 and printing section 12, at least in a broad sense each of these three features have certain uniqueness independently of the others. For example, although not the preferred arrangement of things, the structure 38 on the printing section 12 could consist solely of the lever 40 without the reset lever 42, plus some additional means not illustrated, for swinging the latch lever 40 between its latching and releasing positions. In this instance, the jaw 56 would be utilized only as a means for cooperating with the latch lever 40 to retain inker 10 and printing section 12 together, and as a means for effecting the slight separation of the two. Latch lever 40 would be held in a stationary position by the additional device not illustrated, so that the jaw 56, operating simply as a catch-type element rather than as one jaw of a clamp, would simply be retracted up against the underside of the lever 40, which under the circumstances would function simply as a stationary shoulder. The stationary shoulder could, of course, be swung to its released position by the additional device not illustrated, whereupon the inker 10 and the printing section 12 could be readily swung apart on a large scale. This arrangement, of course, would in no way interfere with the ability of the jaw 56 to function as a means for pushing the inker 10 and the printing section 12 slightly apart through its engagement with the upper surface 20*a* of the frame member 20 when the rod 54 is extended.

As another example, note that the clamping jaws 56 and 60, in cooperation with the latch lever 40, have utility as a hold-down arrangement independently of the use of the jaw 56 as a separating means for the roll 14 and the plate cylinder 18. In this regard, although it is not a preferred way of operation, the capacity of the jaw 56 as a separator for roll 14 and cylinder 18 need never be utilized. The latching, hold-down, release and resetting features of the present invention are thus significant in their own right.

Having thus described the invention, what is claimed as new and desired to be secured by Letters Patent is:

1. In a printing press having a printing section provided with a pair of opposed, upright frame members rotatably supporting at least a plate cylinder, and an inker section operably associated with the printing section provided with opposed, upright frame members supporting at least an ink form roll for rolling engagement with the plate cylinder, said inker section being pivotally mounted on the printing section for swinging movement relative thereto in a direction to move the ink form roll out of operable engagement with the plate cylinder, the combination with said printer and inker sections of:

interengageable stop means on the frame members of the printing section and inker section respectively for limiting swinging movement of the inker section toward the printing section, said stop means being adjustable to permit selective variation of the degree of interengagement between the ink form roll and the plate cylinder controlled by the disposition of the inker section with respect to the printing section;

a latch lever pivotally mounted on one of the sections proximal to the other section; and a remotely actuatable unit on said other section provided with a reciprocable element having jaw means thereon located to clampingly engage the latch lever to lock the inker section against the printing section with the stop means interengaged when the element is adjacent one end of its path of travel and regardless of the adjusted positions of the stop means, said element having means operable to contact said one section when shifted toward the opposite end of its path of travel and effect shifting of the inker section through an arcuate displacement sufficient to move the ink form roll at least slightly out of engagement with the plate cylinder.

2. A printing press as set forth in claim 1 wherein said unit is a fluid actuated cylinder and the element is a piston rod extending from one end thereof, said jaw means comprising a jaw secured to the outer end portion of the rod for movement therewith, there being a stationary jaw proximal to the cylinder in disposition for cooperative action with the movable jaw for trapping said latch lever therebetween when the rod element is shifted toward said one end of its path of travel.

3. A printing press as set forth in claim 2 wherein is provided a reset lever joined to said latch lever at angle relative thereto and located to be engaged by the movable jaw to return the latch lever to a location to be clamped between the jaws after the inker section has been swung through an arc away from the printing section through a displacement causing the movable jaw to engage the latch lever and pivot the latter past the latching position thereof.

4. A printing press as set forth in claim 3 wherein is provided friction means associated with said levers for maintaining the same in the deflected positions thereof caused by swinging of the inker section through said displacement thereof away from the printing section.

5. In a printing press having a printing section provided with a pair of opposed, upright frame members rotatably supporting at least a plate cylinder, and an inker section operably associated with the printing section provided with opposed, upright frame members rotatably supporting at least an ink form roll for rolling engagement with the plate cylinder, said inker section being pivotably mounted on the printing section for swinging movement relative thereto in a direction to move the ink form roll out of operable engagement with the plate cylinder, and gear means coupled to said plate cylinder and said ink form roll respectively for meshing engagement when the ink form roll is against the plate cylinder and configured to remain in such meshing relationship until after the ink form roll has been moved out of contact with the plate cylinder through a predetermined arcuate displacement, the combination with said printing and inker sections of:

interengageable stop means on the frame members of the printing section and inker section respectively for limiting swinging movement of the inker section toward the printing section, said stop means being adjustable to permit selective variation of the degree of interengagement between the ink form roll and the plate cylinder controlled by the disposition of the inker section with respect to the printing section;

a latch lever pivotably mounted on one of the sections proximal to the other section; and a remotely actuatable unit on said other section provided with a reciprocable element having jaw means thereon located to clampingly engage the latch lever to lock the inker section against the printing section with the stop means in interengagement when the element is at one end of its path of travel, said element having means operable to contact said one section when shifted to the opposite end of its path travel of travel and effect shifting of the inker section through an arcuate displacement sufficient to move the ink form roll out of engagement with the plate cylinder but insufficient to move the gear means out of said meshing relationship, said latch lever being mounted to clear the jaw means when the inker section is pivoted through an arcuate displacement sufficient to move the gear means on said plate cylinder and ink form roll respectively out of said meshing relationship and to be disposed to again be clamped by the jaw means when the inker section is returned to its location with the ink form roll engaging the plate cylinder.

6. A printing press as set forth in claim 5 wherein said unit is a fluid actuated cylinder and the element is a piston rod extending from one end thereof, said jaw means comprising a jaw secured to the outer end portion of the rod for movement therewith, there being a stationary jaw proximal to the cylinder in disposition for cooperative action with the movable jaw for trapping said latch lever therebetween when the rod element is shifted toward said one end of its path of travel.

7. A printing press as set forth in claim 6 wherein is provided a reset lever joined to said latch lever at angle relative thereto and located to be engaged by the movable jaw to return the latch lever to a location to be clamped between the jaws after the inker section has been swung through an arc away from the printing section through a displacement causing the movable jaw to engage the latch lever and pivot the latter past the latching position thereof.

* * * * *